US011466596B2

(12) United States Patent
Gelter et al.

(10) Patent No.: US 11,466,596 B2
(45) Date of Patent: Oct. 11, 2022

(54) RECIPROCATING-PISTON MACHINE

(71) Applicant: AVL LIST GMBH, Graz (AT)

(72) Inventors: Jürgen Gelter, Graz (AT); Andreas Zurk, Weinburg (AT)

(73) Assignee: AVL List GmbH, Graz (AT)

( * ) Notice: Subject to any disclaimer, the term of this patent is extended or adjusted under 35 U.S.C. 154(b) by 242 days.

(21) Appl. No.: 16/091,214

(22) PCT Filed: Mar. 30, 2017

(86) PCT No.: PCT/AT2017/060081

§ 371 (c)(1),
(2) Date: Oct. 4, 2018

(87) PCT Pub. No.: WO2017/173471

PCT Pub. Date: Oct. 12, 2017

(65) Prior Publication Data

US 2019/0112951 A1 Apr. 18, 2019

(30) Foreign Application Priority Data

Apr. 5, 2016 (AT) ..... A 50275/2016

(51) Int. Cl.
*F01L 1/14* (2006.01)
*F01L 1/18* (2006.01)
(Continued)

(52) U.S. Cl.
CPC ..... *F01L 1/146* (2013.01); *F01L 1/181* (2013.01); *F01L 1/245* (2013.01); *F01L 9/10* (2021.01);
(Continued)

(58) Field of Classification Search
CPC . F01L 1/146; F01L 1/181; F01L 1/245; F01L 9/02; F01L 9/00; F01L 13/0015;
(Continued)

(56) References Cited

U.S. PATENT DOCUMENTS 3,490,423 A * 1/1970 Haverdink ..... F01L 13/0031 123/90.16
5,012,778 A 5/1991 Pitzi
(Continued)

FOREIGN PATENT DOCUMENTS

DE 4334006 A1 4/1995
EP 2340362 B1 10/2012
(Continued)

*Primary Examiner* — Devon C Kramer
*Assistant Examiner* — Kelsey L Stanek
(74) *Attorney, Agent, or Firm* — Dykema Gossett PLLC

(57) ABSTRACT

The invention relates to a reciprocating-piston machine, comprising a valve actuation device for at least one gas exchange valve, at least one valve stroke transmission device, which has at least one valve stroke transmission element, which is arranged between the gas exchange valve and the camshaft and which is mounted for movement between a first Position associated with a closed Position of the gas exchange valve and a second Position associated with an open position of the gas exchange valve, at least one halting device having a halting element mounted for movement between an actuation position and a release position in a machine housing or a housing-fixed component parallel to a guiding surface of the first valve stroke transmission element that the halting element at least shows the displacement motion of the first valve stroke transmission element and releases said displacement motion in the release position.

16 Claims, 2 Drawing Sheets

(51) Int. Cl.
*F01L 13/06* (2006.01)
*F01L 9/10* (2021.01)
*F01L 1/245* (2006.01)
*F01L 13/00* (2006.01)

(52) U.S. Cl.
CPC ..... *F01L 13/0015* (2013.01); *F01L 13/06* (2013.01); *F01L 2001/256* (2013.01); *F01L 2013/0089* (2013.01); *F01L 2305/00* (2020.05)

(58) Field of Classification Search
CPC ..... F01L 13/06; F01L 2001/256; F01L 2013/0089; F01L 2105/00; F01L 1/25
USPC ..... 123/90.1
See application file for complete search history.

(56) References Cited

U.S. PATENT DOCUMENTS 5,692,469 A * 12/1997 Rammer ..... F01L 13/06 123/321
5,829,397 A * 11/1998 Vorih ..... F01L 13/06 123/90.12
8,347,839 B2 * 1/2013 Berger ..... F01L 9/11 123/90.16
10,428,746 B2 * 10/2019 Hedvik ..... F01L 1/08
10,526,928 B2 * 1/2020 Wetzel ..... F01L 13/0036
2007/0204818 A1 * 9/2007 Dingle ..... F01L 1/24 123/90.16
2009/0000581 A1 * 1/2009 Ellison ..... F01L 13/0005 123/90.16

FOREIGN PATENT DOCUMENTS

WO 2010012864 A1 2/2010
WO 2010125235 A1 11/2010
WO WO-2010125235 A1 * 11/2010 ..... F01L 1/255
WO 2014060645 A1 4/2014
WO WO-2014060645 A1 * 4/2014 ..... F01L 9/025

* cited by examiner

RECIPROCATING-PISTON MACHINE

CROSS-REFERENCE TO RELATED APPLICATIONS

This application is a national stage filing based upon International PCT Application No. PCT/AT2017/060081, filed 30 Mar. 2017, which claims the benefit of priority to Austria application No. A 50275/2016, filed 5 Apr. 2016.

BACKGROUND

Reciprocating-piston machine comprising a valve actuation device for at least one gas exchange valve, at least one valve stroke transmission device which has at least one first valve stroke transmission element, which is arranged between the gas exchange valve and the camshaft and which is mounted for movement between a first position associated with a closed position of the gas exchange valve and a second position associated with an open position of the gas exchange valve, and at least one retaining device having a retaining element is arranged in such a way that the retaining element is mounted for movement between an actuation position and a release position in a machine housing—in particular a cylinder head—or a housing-fixed component parallel to a guide surface of the first valve stroke transmission element in such a way that, in its actuation position, it at least retards the displacement movement of the first valve stroke transmission element in the direction of the second position and releases it in the release position, wherein the retaining element has an attack surface and said surface delimits a pressure chamber with a counter-surface.

Retaining devices are used to change the closing time of the gas exchange valve. Such devices—also known as "lost motion" mechanisms—can be used to easily implement engine braking and/or decompression functions.

Retaining devices for valve stroke transmission devices are known, for example, from EP 2 340 362 B1. In this case, the retaining device has a piston which is guided in a part of the valve stroke transmission device moved by the camshaft. As the piston is moved along with the valve stroke transmission device, the moved masses increase. This leads to increased wear and increased energy requirements. Furthermore, this well-known solution requires an increased construction effort.

It is the object of the invention is to avoid these disadvantages and to provide a simple way to retain the gas exchange valve.

SUMMARY OF THE INVENTION

This object is achieved in that the counter-surface and the guide surface are fixed to the housing, preferably in the machine housing. This measure has the advantage that the retaining element does not have to be moved with the moving parts of the valve stroke transmission device. The moved masses are lower compared to those of conventional equipment. Furthermore, there is the advantage that a displacement of the retaining element is easier to realize, which benefits the simplicity of the construction.

It is particularly advantageous if the retaining element is formed by a piston, preferably an annular piston. This leads to the advantage that the area required for the retaining element can be reduced to a minimum.

A particularly simple and space-saving arrangement results when the retaining element is arranged concentrically to the first valve stroke transmission element and at least partially surrounds it.

A compact actuation possibility for the retaining element arises if the pressure chamber can be hydraulically or pneumatically connected to a pressure source via at least one first valve, preferably in the form of a 3/2-way valve, and the retaining element can be deflected by applying pressure to the pressure chamber against a restoring force, preferably formed by a spring.

In order to optimize the wear and running properties of the retaining device, it is advantageous if the guide surface is formed by an outer circumferential surface of a guide sleeve fixed to the housing, wherein preferably the first valve stroke transmission element is mounted displaceably on an inner circumferential surface of the guide sleeve.

An advantageous embodiment variant is obtained if the first valve stroke transmission element—preferably designed as a multi-part plunger—has a first transmission part and a second transmission part, wherein the second transmission part is mounted displaceably along the displacement axis in the first transmission part. This allows a simple relative movement between the first and second transmission part.

It is advantageous if a hydraulic valve clearance compensation is arranged in the transmission part. This allows the valve clearance to be compensated automatically.

It is particularly advantageous if the first valve stroke transmission element has at least one coupling region for a further valve stroke transmission element on at least one end face, preferably on both end faces facing away from one another, wherein the coupling region is preferably in the form of a ball socket. The advantage here is that these coupling regions allow the lowest possible loss of power to be transmitted.

The same advantage arises if at least one other valve transmission element is formed by a push rod or a valve lever.

A particularly simple arrangement is obtained when the first valve stroke transmission element is arranged between at least one push rod and at least one valve lever.

For reasons of safety and reliability, it is advantageous if the pressure chamber can be hydraulically or pneumatically connected to a pressure reservoir via at least one second valve, preferably designed as a throttle non-return valve.

BRIEF DESCRIPTION OF THE DRAWINGS

In the following, an exemplary embodiment of the invention is explained in more detail on the basis of the non-restrictive figures, wherein.

DETAILED DESCRIPTION

Figure 1:
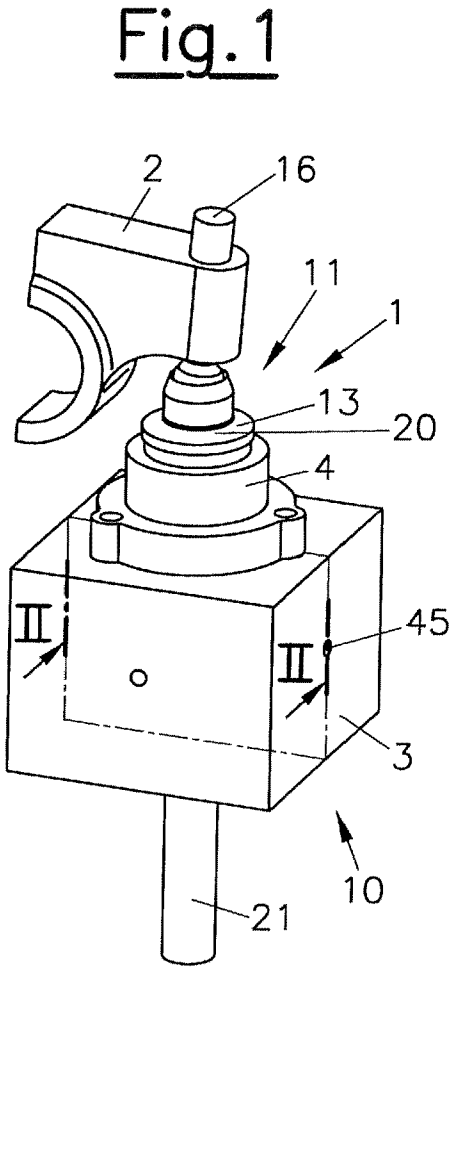
FIG. 1 shows a valve actuation device of a reciprocating-piston machine according to the invention in an oblique elevated view.

FIG. 1 shows a valve actuation device 10 of a reciprocating-piston machine 1 according to the invention. The reciprocating-piston machine 1 has gas exchange valves (not shown), which are mechanically connected via a valve lever 2 to the valve actuation device 10. FIG. 1 shows a component 3 fixed to the housing and a piston holder 4, which retain a valve stroke transmission device 11 shown in FIG. 2.

This valve stroke transmission device 11 has a multi-part plunger which forms a first valve stroke transmission element 12, which in turn has a first 13 and a second transmission part 14. The first transmission part 13 is displaceably mounted in the second transmission part 14, wherein a piston region 5 of the first transmission part 13 is guided in a cylindrical guide region 6, for example, of the second transmission part 14. The displacement of the first valve stroke transmission element 12 is possible along a displacement axis 15, wherein the displacement axis 15 also forms the axis of the cylindrical transmission parts 13, 14. The first valve stroke transmission element 12 has a respective coupling region at both ends. A first coupling region is arranged between the first transmission part 13 and a connecting bolt 16, which transmits the movement of the valve stroke transmission device 11 to the valve lever 2. The coupling region has a ball socket 17*a* connected to the first transmission part 13 to receive a ball 18 of the connecting bolt 16, which is firmly connected to the valve lever 2. A coupling element 19 is designed as a shell open towards the connecting bolt 16, which rests on a connecting plate 20 of the first transmission part 13.

The coupling region of the second transmission part 14 is arranged facing away from the valve lever 2 in the direction of a push rod 21. This coupling region between second transmission part 14 and push rod 21 is formed by the ball socket 17*b*.

The valve stroke transmission device 11 is arranged in a cylindrical recess 22 in the component 3 fixed to the housing. In this case, the displacement axis 15 is identical with a cylinder axis 23 of the cylindrical recess 22.

The second transmission part 14, facing away from the coupling region, has a shoulder 24 with a shoulder ring surface 25 facing into the interior of the cylindrical recess 22. The cylindrical recess 22 has an offset 26 having a first offset ring surface 27 facing the push rod 21 and a second offset ring surface 28 facing the valve lever 2.

Between the shoulder 24 and the offset 26 there is a compression spring 29 which is supported on the first offset ring surface 27 against the shoulder ring surface 25. It counteracts a lifting movement of the push rod 21.

There is no contact between an offset inner surface 30 of offset 26 and an outer circumferential surface 31 of the second transmission part 14.

A guide sleeve 32 fixed to the housing rests on the second offset ring surface 28. It is arranged concentrically to the transmission parts 13, 14 and has an inner circumferential surface 33 and a guide surface 34 formed by an outer circumferential surface. The second transmission part 14 of the first valve stroke transmission element 12 is displaceably mounted on the inner circumferential surface 33. A retaining element 40 is displaceably mounted on the guide surface 34.

An annular piston 40*a* is used in the shown embodiment as the retaining element 40. It has an attack surface 41, which forms part of a boundary of a pressure chamber 42. In order to guarantee a minimum volume for this pressure chamber 42, an abutment 43 on the annular piston 40*a* on the attack surface 41 is used, which in this case does not extend beyond the entire circumference of the annular piston 40*a*.

On the annular piston 40*a*, a spring 44 rests against the piston holder 4 in the direction of the valve lever 2. The piston holder 4 is detachably connected to the housing-fixed component 3 with screws (not shown).

In the illustrated embodiment, the pressure chamber 42 is bordered by the attack surface 41, the guide surface 34, the component 3 fixed to the housing and the piston holder 4. Opposite the attack surface 41 there is a counter-surface 35 of the component 3 that is fixed to the housing.

For the supply of the pressure into the pressure chamber 42 and the discharge therefrom, pressure lines 45 are located in the component 3 fixed to the housing and in the piston holder 4. The pressure lines 45 are formed in the exemplary embodiment in the component 3 fixed to the housing by two holes at right angles to each other.

Figure 2:
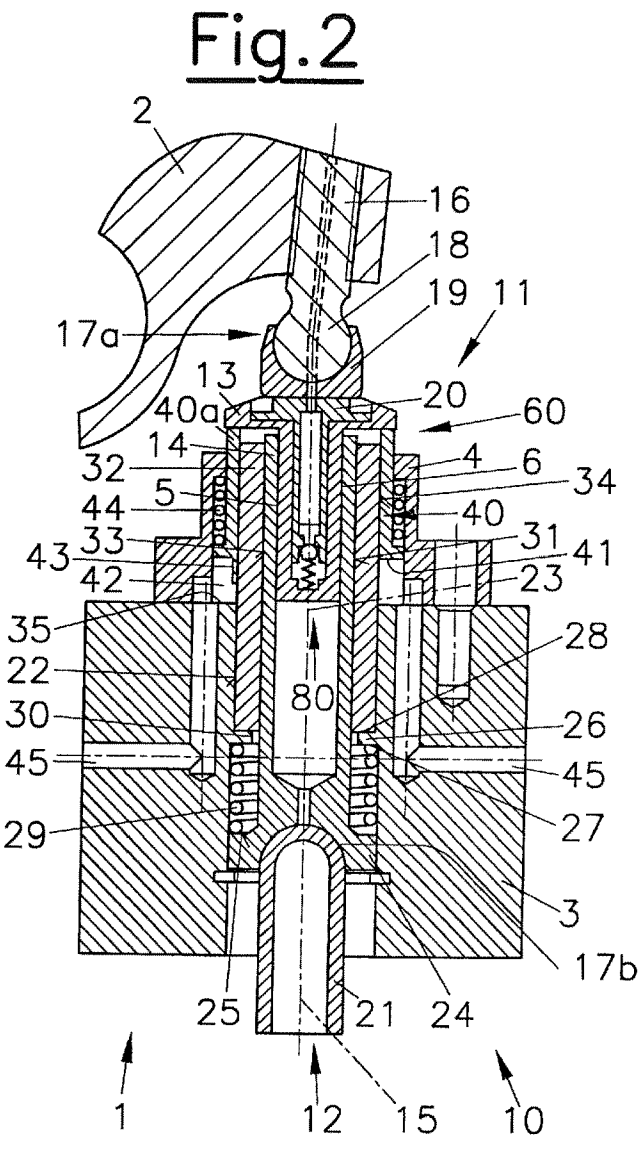
FIG. 2 shows the valve actuation device in a sectional view according to lines II-II in FIG. 1 with a retaining element in an actuation position.

For deceleration, while the valve lever is moving, the annular piston 40*a* is pushed in the direction of the connection plate 20 by pressure in the pressure chamber 42. Via the stroke of the first transmission part 13, it is passed via the coupling region to the connecting bolt 16 and thus to the valve lever 2, which causes a delay in the further movement of the valve lever 2 in the direction of the push rod 21, as shown by FIG. 2.

The retaining element 40, which is designed as an annular piston 40*a* in the described exemplary embodiment, thus causes at least a delay up to a blocking of the movement of the valve lever 2 in the direction of the push rod 21. The downward movement of the valve lever 2 is thus decelerated and the closing of the valve is delayed.

The retaining element 40 and the annular piston 40*a* are guided via the guide surface 34 of the guide sleeve 32. The inner circumferential surface 33 of this guide sleeve 32 serves to guide the second transmission part 14.

The compression spring 29 ensures contact between the push rod 21 and the second transmission part 14.

Figure 3:
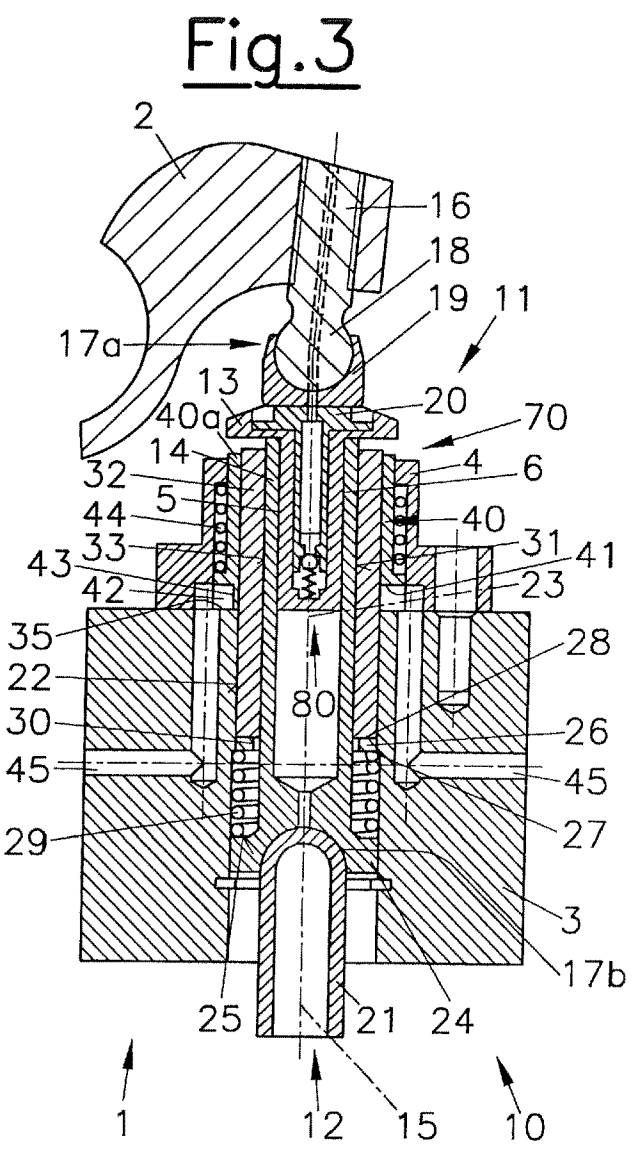
FIG. 3 shows the valve actuation device in a sectional view analogous to FIG. 2 with the retaining element in a release position.

If the pressure chamber 42 is depressurized, the retaining element 40 and the annular piston 40*a* are pressed by the spring 44 in the direction of the push rod 21. This separates the traction between the first transmission part 13 and the retaining element 40. The movement of the valve lever 2 is then transmitted to the push rod 21 by the first transmission part 13 and the second transmission part 14, as shown in FIG. 3.

A hydraulic valve clearance compensation 80 is provided in the transmission part 13.

In another embodiment, the retaining element 40 is designed as a single journal piston arranged on one side of the guide sleeve 32. In addition, several journal pistons can form the retaining element 40, which are arranged around the guide sleeve 32 on different sides and diametrically, for example, with two journal pistons.

Figure 4:
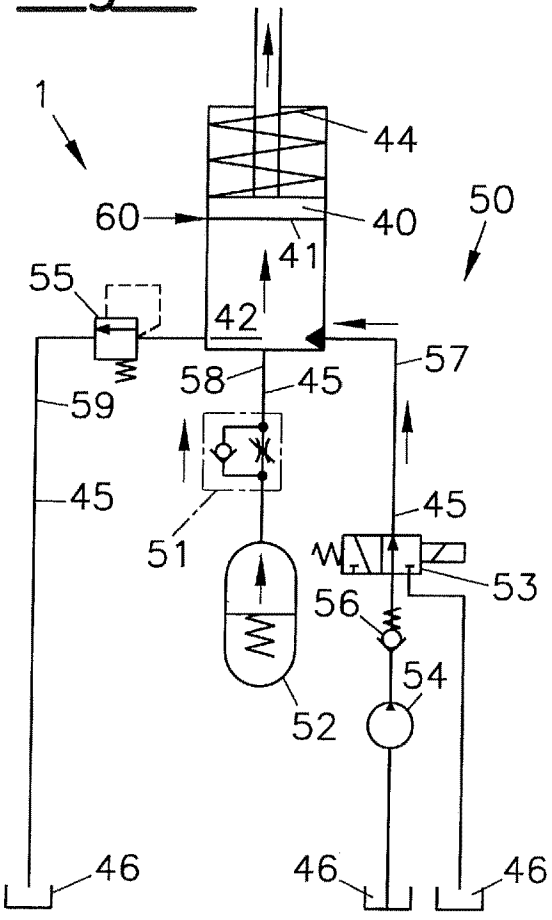
FIG. 4 shows a control arrangement of a reciprocating-piston machine according to the invention in a first position.

FIG. 4 shows a control arrangement 50 of reciprocating-piston machine 1 which applies pressure to the pressure chamber 42. The drawing shows the pressure chamber 42, the spring 44, which provides the reset of the retaining element 40, the retaining element 40, a throttle non-return valve 51, a pressure reservoir 52, a 3/2-way valve 53, a pressure source 54, a pressure relief valve 55, a non-return valve 56, the pressure lines 45 and a tank 46.

A main supply line 57 comprises the tank 46, the pressure source 54, the non-return valve 56 and the 3/2-way valve 53.

A pressure reservoir line 58 leads from pressure chamber 42 to the throttle non-return valve 51 to the pressure reservoir 52. And an overpressure line 59 leads from pressure chamber 42 via pressure relief valve 55 to tank 46. This overpressure line 59 is intended to prevent the gas exchange valve from remaining open.

Figure 5:
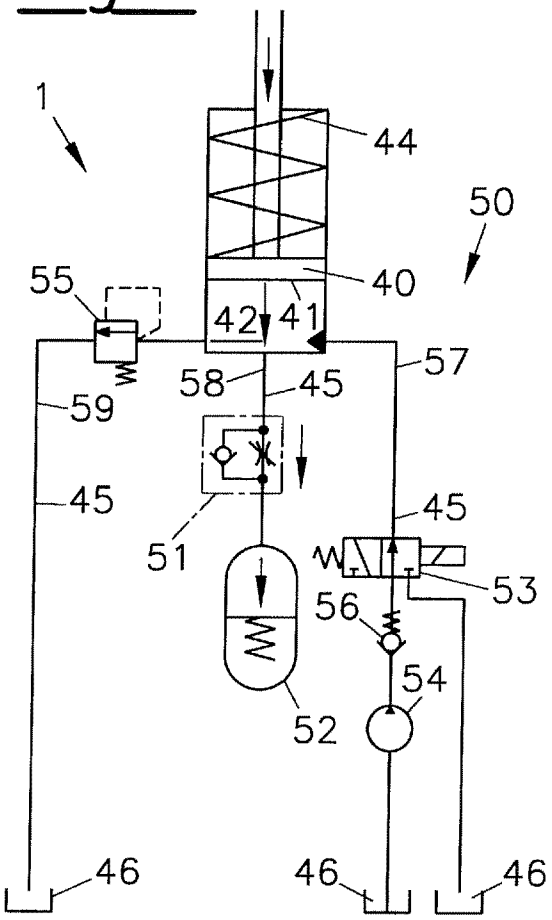
FIG. 5 shows the control arrangement in a second position.

If the 3/2-way valve is actuated, the pressure chamber 42 is filled via the main supply line 57 when the gas exchange valves are opened for the first time in the open position. When pressure is applied to the attack surface 41 of the retaining element 40, it moves in the direction of the valve lever 2 to an actuation position 60. When the retaining element 40 is reset to the release position 70 the pressure reservoir 52 fills up, as shown in FIG. 5. When the gas exchange valve is opened further, the pressure from the pressure reservoir 52 is made available, as shown in FIG. 4. Leaks are compensated via the main supply line 57.

Figure 6:
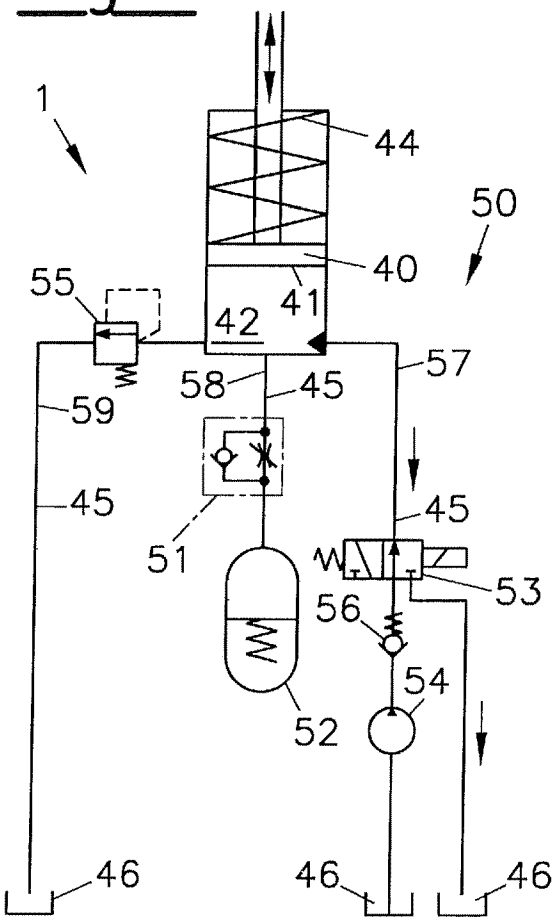
FIG. 6 shows the control arrangement in a third position.

FIG. 6 shows the return flow from the pressure chamber via the main supply line 57 to the closed position when the gas exchange valve is closed, if the 3/2-way valve 53 is not actuated. Then the force of the spring 44 prevails over the pressure applied to the attack surface 41 and the retaining element 40 moves to a release position 70.

In an embodiment not shown, the main supply line 57 and the pressure storage line 58 are joined before entering the pressure chamber 42.

The retaining element 40 can be moved hydraulically or pneumatically.

The invention claimed is:

1. Reciprocating-piston machine comprising:

a valve actuation device for at least one gas exchange valve;

at least one valve stroke transmission device including at least one first valve stroke transmission element, which is arranged between a valve lever and a push rod, and is configured and arranged for movement between a first position associated with a closed position of the gas exchange valve and a second position associated with an open position of the gas exchange valve; and at least one retaining device including a retaining element, the retaining element is configured and arranged for movement between an actuation position and a release position in a cylinder head or a housing-fixed component parallel to a guide surface of the at least one first valve stroke transmission element, wherein in an actuation position the retaining element at least retards a displacement movement of the at least one first valve stroke transmission element in a direction of the second position and releases the at least one first valve stroke transmission element in the release position, wherein the retaining element includes an attack surface configured and arranged to delimit a pressure chamber with a counter-surface, characterized in that the counter-surface and the guide surface are fixed to the cylinder head or the housing-fixed component;

wherein the retaining element is arranged concentrically to the at least one first valve stroke transmitting element and surrounds the at least one first valve stroke transmitting element at least in part.

2. The reciprocating-piston machine according to claim 1, characterized in that the retaining element is formed by a piston.

3. The reciprocating-piston machine according to claim 2, characterized in that the pressure chamber is connected hydraulically or pneumatically to a pressure source via at least one first valve, wherein the retaining element is further configured and arranged to be deflectable against a restoring force by applying pressure to the pressure chamber.

4. The reciprocating-piston machine according to claim 3, wherein the at least one first valve is a 3/2-way valve.

5. The reciprocating-piston machine according to claim 4, wherein the restoring force is provided by a spring.

6. The reciprocating-piston machine according to claim 2, characterized in that the pressure chamber is configured and arranged to be connected hydraulically or pneumatically to a pressure reservoir via at least one second valve.

7. The reciprocating-piston machine according to claim 6, wherein the at least one second valve is a throttle non-return valve.

8. The reciprocating-piston machine according to claim 2, wherein the piston is an annular piston.

9. The reciprocating-piston machine according to claim 1, characterized in that the at least one first valve stroke transmission element has at least one coupling region for a further valve stroke transmission element on at least one end face.

10. The reciprocating-piston machine according to claim 9, characterized in that the further valve transmission element is formed by another push rod or another valve lever.

11. The reciprocating-piston machine according to claim 9, wherein the at least one first valve stroke transmission element has the at least one coupling region on both end faces facing away from one another, and wherein the at least one coupling region is a ball socket.

12. The reciprocating-piston machine according to claim 1, wherein the counter-surface and the guide surface are arranged within the cylinder head or the housing-fixed component.

13. Reciprocating-piston machine comprising:

a valve actuation device for at least one gas exchange valve;

at least one valve stroke transmission device including at least one first valve stroke transmission element, which is arranged between a valve lever and a push rod, and is configured and arranged for movement between a first position associated with a closed position of the gas exchange valve and a second position associated with an open position of the gas exchange valve; and at least one retaining device including a retaining element, the retaining element is configured and arranged for movement between an actuation position and a release position in a cylinder head or a housing-fixed component parallel to a guide surface of the at least one first valve stroke transmission element, wherein in an actuation position the retaining element at least retards a displacement movement of the at least one first valve stroke transmission element in a direction of the second position and releases the at least one first valve stroke transmission element in the release position, wherein the retaining element includes an attack surface configured and arranged to delimit a pressure chamber with a counter-surface, characterized in that the counter-surface and the guide surface are fixed to the cylinder head or the housing-fixed component;

wherein the guide surface is formed by an outer circumferential surface of a guide sleeve fixed to the cylinder head or the housing-fixed component.

14. The reciprocating-piston machine according to claim 13, wherein the at least one first valve stroke transmission element is displaceably mounted on an inner circumferential surface of the guide sleeve.

15. Reciprocating-piston machine comprising:

a valve actuation device for at least one gas exchange valve;

at least one valve stroke transmission device including at least one first valve stroke transmission element, which is arranged between a valve lever and a push rod, and is configured and arranged for movement between a first position associated with a closed position of the gas exchange valve and a second position associated with an open position of the gas exchange valve; and at least one retaining device including a retaining element, the retaining element is configured and arranged for movement between an actuation position and a release position in a cylinder head or a housing-fixed component parallel to a guide surface of the at least one first valve stroke transmission element, wherein in an actuation position the retaining element at least retards a displacement movement of the at least one first valve stroke transmission element in a direction of the second position and releases the at least one first valve stroke transmission element in the release position, wherein the retaining element includes an attack surface configured and arranged to delimit a pressure chamber with a counter-surface, characterized in that the counter-surface and the guide surface are fixed to the cylinder head or the housing-fixed component;

wherein the at least one first valve stroke transmission element has a first transmission part and a second transmission part, wherein the second transmission part is displaceably mounted along a displacement axis in the first transmission part.

16. The reciprocating-piston machine according to claim 15, wherein the at least one first valve stroke transmission element is a multi-part plunger.

* * * * *